United States Patent [19]

Cook

[11] 4,206,524

[45] Jun. 10, 1980

[54] INVALID SUPPORTING STRUCTURE

[76] Inventor: Roger G. Cook, 213 Greeley St., Hightstown, N.J. 08520

[21] Appl. No.: 949,880

[22] Filed: Oct. 10, 1978

[51] Int. Cl.[2] ..... A47C 23/00

[52] U.S. Cl. ..... 5/468; 5/481; 5/469

[58] Field of Search ..... 297/284, 453–458; 128/38–40, 68.1, 82.1

[56] References Cited

U.S. PATENT DOCUMENTS

| | | | |
|---|---|---|---|
| 3,111,345 | 11/1963 | Peras | 297/455 |
| 3,381,999 | 5/1968 | Steeve, Jr. | 297/453 |
| 3,757,356 | 9/1973 | Freeman | 5/453 |
| 3,757,366 | 9/1973 | Sacher | 297/453 X |
| 4,057,861 | 11/1977 | Howarth | 5/468 |

*Primary Examiner*—Casmir A. Nunberg

*Attorney, Agent, or Firm*—George F. Mueller

[57] ABSTRACT

An invalid supporting structure for relieving pressure on bony areas or any other desired area of a received person to alleviate decubitus ulcers and accelerate the healing thereof. The structure comprises a resilient, sponge-like pad having at least one aperture located at a predetermined position adapted to register with a desired area of a person with means for passing a gas into and venting the gas from the aperture.

8 Claims, 3 Drawing Figures

INVALID SUPPORTING STRUCTURE

This invention relates to resilient body-supporting mats or pads adapted for use by invalids, particularly bedridden and immobile invalids.

Bedridden persons, particularly those who as a result of disease, injuries, strokes, burns and other afflictions are confined to bed for prolonged periods of time and are immobile, develop decubitus ulcers or bed sores. These ulcers generally develop at relatively bony areas. At the trochanteric or lumbar (hip) areas, thoracic (upper back) area, spinal area and coccyx area little flesh is present and blood circulation is minimal. Although the position of the person may be moved from time to time by a nurse or an attendant, there is a concentration of pressure at these areas while the person is lying with any one or more of the areas in contact with the underlying supporting mattress or other supporting means. This concentration of pressure reduces the blood circulation or may interrupt the circulation which causes a deterioration of the flesh and skin resulting in the development of ulcers at these locations. In the case of immobile persons, once the ulcers develop it is extremely difficult to effect a healing of the ulcerated site.

A variety of resilient body-supporting pads or mats for invalids and temporarily incapacited persons have been proposed and have been used. Perhaps the most commonly known pad in general use is the inflated annular cushion. For the bedridden person, this type of pad does not conform to a large area of the body and does not improve the comfort of the person. In addition, each time the position of the person is altered, it is necessary to lift the person and reposition the pad. Other types of supporting pads or mats are formed of resilient sponge materials and are provided with apertures adapted to be positioned under the desired bony areas. In the use of this type of pad, each time the body of the person is shifted, as from a prone position to one side or from side to side, it is also necessary to lift the person and possibly reposition the pad. In order to reduce the strain on both the patient and the attendant, various sizes of pads have been proposed having spaced apertures or openings so that a pressure relieving opening will underlie the respective bony areas as the patient is moved. Although these openings relieve undesired pressure concentrations, patients continue to experience ulcers which are extremely difficult to cure or heal.

The present invention provides resilient body-supporting mats or pads adapted to equalize the pressure over large areas of the body of the patient.

This invention further provides resilient body-supporting mats or pads having recesses or pressure relieving openings at predetermined areas corresponding to bony areas of a patient or any other desired area.

The invention also provides a recessed, resilient bodysupporting mat or pad having means to maintain a positive ventilation of one or more of the recesses.

Other objects and advantages of the invention will be apparent from the following description taken in conjunction with the drawings wherein.

Figure 1:
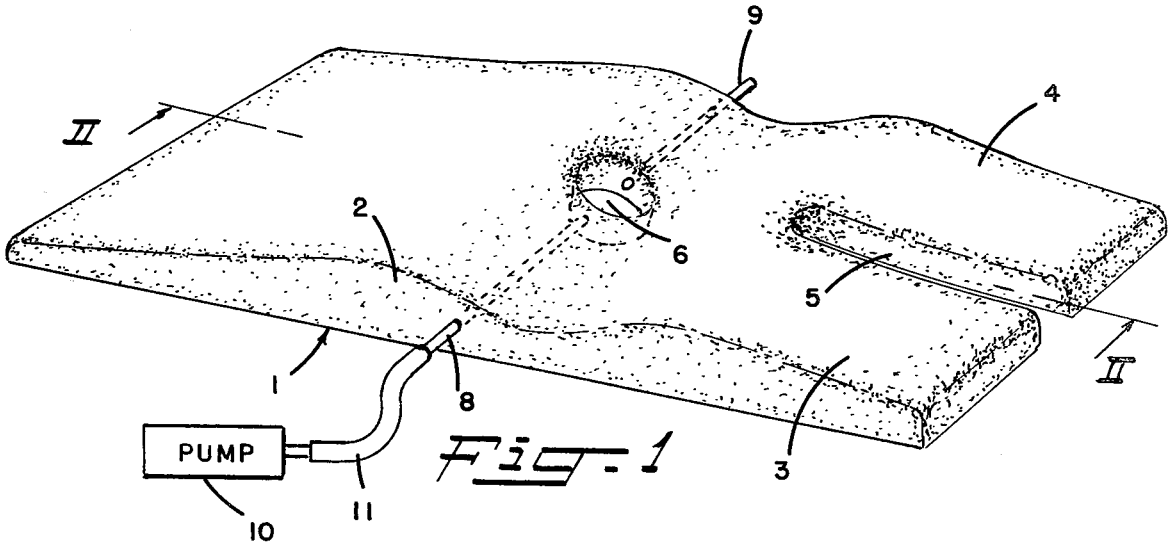
FIG. 1 is a perspective view illustrating a pad adapted to support the lower back, lumbar-coccyx and upper leg areas of a patient.

The pad or mat 1 is formed of a flexible, resilient, cellular material such as, for example, natural or synthetic rubber sponge or foam, polyester foam, polyurethane foam and the like. The selected material should be one which does not cause allergic reactions. The external skin of the pad should be impervious so as to present a smooth surface which may be readily washed and sanitized and to prevent absorption by the pad of perspiration. The surfaces of the pad or mat may be provided with a coating of a synthetic polymer such as, for example, a silicone polymer, a polyacrylic acid ester, a polymethacrylic acid ester, a polyurethane and the like. The coating should contribute to the toughness of the surface to prevent easy rupturing or penetration of the surface.

As illustrated in the drawings, the lower surface is flat or planar and adapted to be placed upon the usual bed mattress or other supporting surface. The thickness of the pad along its longitudinal dimension is preferably varied in accordance with weight distribution and physical contours of the person or persons and the area to be supported. In the case of a pad adapted to support a person from the thoracic area downwardly, such pad will have a maximum thickness at that portion corresponding to the lumbar area, as at 2. The length and width of the pad is such as to accommodate persons of different size (adult, children, etc.). The length is such as to provide support for the upper legs. The lower end of the pad is bifurcated to provide individual leg supporting areas 3 and 4 and a slot 5 extending upwardly to the pelvic area. The relief slot 5 allows a natural circulation of air between the supported leg portions and also provides an open gap or space to accommodate catheter tubes and the like.

The firmness or density of the sponge or foam material should be sufficiently soft or pliant to conform to the general contour of the body but sufficiently firm so as to support the body without becoming completely compressed. The degree of firmness or density and the relative thickness should be such as to avoid concentration of pressure particularly on bony areas and to provide a uniform support of the body over its entire supported area.

An aperture 6 extending from the top to the bottom of pad is provided centrally of the pad in the coccyx area. The upper wall defining the aperture is flared, as at 7, so as to avoid a sharp edge which might result in an irritation should the person move or stir. The chamber formed by the aperture is vented by means of conduits 8 and 9. The conduits may be inserted into the molded pad or they may be positioned in a mold and the pad formed about the conduits. The conduits extend laterally from the chamber through a side wall of the pad to provide nipples beyond the walls of the pad.

It has been found that the healing of an ulcer is accelerated by a positive circulation of air and the venting of the air from the chamber. The air is supplied by a low pressure pump 12 through a suitable hose 11 connected to one of the conduits. The air is exhausted through the other conduit. Any desired low pressure pump is satisfactory, the type of pumps used in aerating aquariums having been found to be adequate. Positive circulation of air through the chamber is effective in preventing the development of ulcers, but of greater significance is the efficacy in facilitating the healing of unyielding ulders when present.

Figure 3:
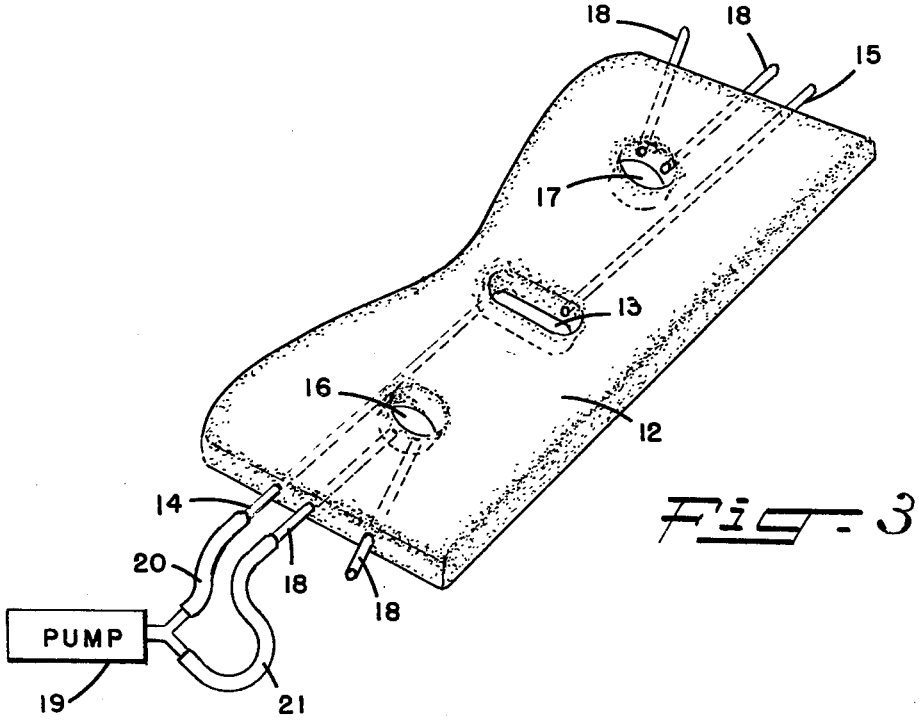
FIG. 3 is a perspective view illustrating a pad adapted to support the upper back or thoracic area of a patient.

FIG. 3 illustrates a pad 12 adapted to accommodate the thoracic area of a patient. The pad is provided with a centrally located elongated aperture 13 adapted to register with the upper portion of the spinal column of a patient. As described hereinbefore, the upper wall of all apertures is flared so as to avoid presenting sharp edges. The chamber formed by the aperture is vented by means of conduits 14 and 15, either of which may be used as the inlet for the air supplied by a suitable pump. Outwardly spaced apertures 16 and 17 are located so as to register with the bony shoulder areas of a patient as the patient is turned from side to side. The chambers formed by the apertures are vented by suitable conduits 18. Air is passed into the chamber or chambers formed by the aperture or apertures and vented therefrom by means of pump 19 connected to one of the conduits of the apertures through hoses 20 and 21.

Figure 2:
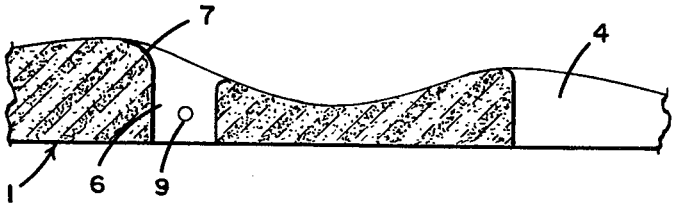
FIG. 2 is partial cross sectional view of the pad taken on line 2—2.

Although FIGS. 1 and 2 illustrate a single aperture at the coccyx area, the pad may be provided with outwardly spaced apertures adapted to register with the bony hip areas of a patient. Such apertures are also provided with conduits for positive venting of the chambers formed by the apertures similar to those shown in FIG. 3. It is obvious that apertures with the venting means may be provided at any other area where it is desired to relieve pressure and effect a positive venting of the chamber formed by the aperture, particularly at a location where an ulcer has developed. Although a body pad and thoracic pad have been shown as independent or separate units, it is obvious that they may be combined into a single pad.

It is apparent that the present invention provides a supporting foam or sponge-like pad having a thickness varying along its longitudinal dimension in accordance with the weight distribution and physical contour of that portion of the body of a patient to be supported. Such thickness variation provides a very uniform support of the body area and minimizes localized stress areas which might contribute to the deterioration of skin and flesh. Concomitantly, the pad is provided with at least one recess or pressure relieving aperture corresponding to any desired area, preferably a bony area or an ulcerated area, of a patient with means for positively venting and maintaining a flow of air through the chamber formed by the aperture. Thus, the aperture or apertures are located at areas where decubitus ulcers occur most frequently. Although reference to air has been made as the ventilating medium, any desired gas may be used.

What is claimed is:

1. An invalid supporting structure comprising a resilient, sponge-like pad having at least one aperture extending from the top to the bottom of the pad and located at a position adapted to register with a predetermined area of a received person, a pair of laterally extending conduits in the pad extending from the aperture to the side wall of the pad and means for passing a gas into and venting the gas from the aperture coupled to one of the conduits, the pad having a thickness varying along its longitudinal dimension in accordance with the weight distribution and physical contour of a person and wherein the density of the pad combined with the variation in thickness prevents a complete compression of the pad when receiving a person and provides a uniform support for the body over the supported area.

2. An invalid supporting structure as defined in claim 1 wherein the skin of the pad is impervious.

3. An invalid supporting structure as defined in claim 1 wherein the aperture is located at a position adapted to register with a bony area of a received person.

4. An invalid supporting structure as defined in claim 3 wherein the aperture is located at a position adapted to register with the coccyx area of a received person.

5. An invalid supporting structure as defined in claim 1 wherein the pad is provided with an aperture located at a position adapted to register with the coccyx area of a person and with a pair of apertures spaced outwardly from said first aperture, said spaced apertures located at positions adapted to register with the bony hip areas of a person as the person is turned from side to side, a pair of laterally extending conduits in the pad for each of the apertures extending from each of the apertures to the side wall of the pad and means for passing a gas into and venting the gas from one or more of the apertures coupled to one of the conduits of a pair of conduits.

6. An invalid supporting structure as defined in claim 1 wherein the pad is adapted to support a person from the thoracic area downwardly and the pad is bifurcated to provide a relief slot from the pelvic area downwardly.

7. An invalid supporting structure as defined in claim 1 adapted to support a person over the thoracic area, the pad having an aperture located at a position adapted to register with the upper portion of the spinal column of a received person.

8. An invalid supporting structure as defined in claim 7 wherein the pad has a pair of apertures spaced outwardly from said first aperture, said spaced apertures located at positions adapted to register with the bony shoulder areas of a person as the person is turned from side to side, a pair of laterally extending conduits in the pad for each of the apertures extending from each aperture to the side wall of the pad and means for passing a gas into and venting the gas from one or more of the apertures coupled to one of the conduits of a pair of conduits.

* * * * *